US005902975A

United States Patent [19]

Coulson et al.

[11] Patent Number: 5,902,975

[45] Date of Patent: May 11, 1999

[54] INTERNAL TRANSMISSION RANGE SWITCH SYSTEM

[75] Inventors: Ethan J. Coulson, Quincy, Mass.; Edward F. O'Brien, West Warwick; Charles M. Anastasia, Barrington, both of R.I.; Alan M. Sadler, North Attleboro; Dale R. Sogge, Wrentham, both of Mass.

[73] Assignee: Texas Instruments Incorporated, Dallas, Tex.

[21] Appl. No.: 08/995,306

[22] Filed: Dec. 22, 1997

[51] Int. Cl.[6] ..... H01H 3/16

[52] U.S. Cl. ..... 200/61.91; 200/61.88

[58] Field of Search ..... 200/16 R–16 F, 200/61.85–61.91

[56] References Cited

U.S. PATENT DOCUMENTS

| | | | |
|---|---|---|---|
| 3,564,151 | 2/1971 | Shlesinger, Jr. | 200/16 A X |
| 3,566,082 | 2/1971 | Ramsetter | 200/46 |
| 3,757,060 | 9/1973 | Ianuzzi et al. | 200/16 C |
| 5,023,414 | 6/1991 | Mihara et al. | 200/61.91 |
| 5,231,254 | 7/1993 | Baker et al. | 200/61.91 |
| 5,338,907 | 8/1994 | Baker et al. | 200/61.88 |
| 5,440,087 | 8/1995 | Cobb, III | 200/61.88 |
| 5,525,768 | 6/1996 | Cobb, III et al. | 200/61.88 |

*Primary Examiner*—J. R. Scott
*Attorney, Agent, or Firm*—Russell E. Baumann; Richard L. Donaldson

[57] ABSTRACT

An internal vehicular transmission range switch (10) has a movable contact support (20) which slides along a straight path in a recess formed between a housing having a base member (12) and cover (14) between first and second extremities in dependence upon the movement of the manual valve (4) to which it is coupled by an arm (18) extending from the support through a slot (16) formed in the housing. An elongated slider having a lower (20*e*) and upper (20*d*) blade portions received in respective channels (12*a*, 14*a*) formed in the housing integrally attached to the movable contact support blocks ingress of contaminant particles into the recess while permitting fluid flow into and out of the recess. A second embodiment (10') has a generally U-shaped member (18') having one leg (18*a'*) attached to the movable contact support and extending through an O-ring (24) in an end wall of the housing and a manual valve coupling arm (18*c'*) formed at the distal end of a second leg (18*b'*). A third embodiment has an endless track (26) in which an elongated, flexible band (28) having opposite ends attached to the movable contact support (20) on opposite sides of manual valve coupling arm (18) blocks entry of contaminant particles through slot (16") in the housing through which arm (18) extends.

18 Claims, 4 Drawing Sheets

INTERNAL TRANSMISSION RANGE SWITCH SYSTEM

FIELD OF THE INVENTION

This invention relates generally to vehicular transmissions and more particularly to apparatus for sensing the position of the manual valve of an automatic transmission which determines the transmissions' mode at any given time.

BACKGROUND OF THE INVENTION

It is conventional to provide a switch assembly to receive mechanical gear selection inputs from the driver of a vehicle through various linkages and output electrical signals to the transmission electronic control unit indicative of the gear selection. Such switch assemblies are coupled to the detent lever and the manual valve of the transmission and generally comprise either a rotary movable contact mechanism such as those shown in U.S. Pat. Nos. 5,527,768 and 5,440,087, assigned to the assignee of the present of the invention, or a straight linear movable contact mechanism such as that shown in U.S. Pat. No. 5,231,254, also assigned to the assignee of the present invention. The present invention relates to the latter type in which an actuator carrying a set of movable contacts is caused to slide back and forth in a straight line in dependence upon the longitudinal movement of the manual valve. The movable contacts are spring biased into engagement with a stationary contact board having contact segments arranged in a selected pattern so that on/off output signals are obtained based on the longitudinal position of the manual valve. The housing of the switch mechanism is open to the passage of transmission fluid including contaminants into and out of the switching chamber.

SUMMARY OF THE INVENTION

It is an object of the present invention to provide a switch mechanism in which a movable contact assembly is movable along a straight linear path in dependence upon the movement of the manual valve of a motor vehicle transmission having a switch housing in which ingress of contaminants into the housing is prevented. Another object of the invention is the provision of a reliable, yet low cost, switch system for detection of gear selection of a motor vehicle transmission which is linked to the manual valve having a housing configured for placement in the housing of the transmission while permitting transmission fluid flow into and out of the switch system housing thereby minimizing any pressure differential between the interior and exterior of the switch housing while excluding ingress of contaminant particles.

Other objects, advantages and details of the switch system of this invention appear in the following detailed description of the preferred embodiments of the invention.

Briefly, in accordance with a first embodiment of the invention, a base member and cover form a housing having a generally cylindrical manual shaft receiving socket and a bolt receiving flange. A movable actuator, received in the housing, comprises a movable contact support integrally attached to an elongated slide element disposed in a track extending along a side of the housing with an arm extending out of an elongated slot formed in a sidewall of the housing for coupling to the manual valve of the transmission. The movable contact support of the actuator is movable in a switch chamber or recess between first and second extremities in dependence upon the position of the manual valve. The slider element closes the slot and is formed with a length sufficiently long so that the slot is closed when the arm is at either of the first and second extremities. The base member and cover are each formed with open ended, aligned, elongated channels having an opening facing each other forming the track for reception of respective lower and upper blade portions of the slider element. A movable contact assembly is mounted on the movable contact support and is biased into engagement with the lower surface of the cover which mounts a stationary contact assembly so that as the actuator is caused to slide between first and second extremities in dependence upon movement of the manual valve as the driver of the vehicle shifts gears, movable contacts of the movable contact assembly will slide into and out of electrical contact engagement with respective stationary contact segments mounted in the cover. Correct alignment of the movable contact path is obtained by means of using the manual shaft as an attachment point with the position of the movable contact assembly referenced directly to the manual valve for optimum system accuracy. The feature of the channel/blade interface while not excluding transmission fluid provides a tortuous path for contaminants thereby preventing ingress of gross contaminants into the switch chamber or recess formed in the housing. According to a feature of the invention, the manual shaft receiving socket has a discontinuous cylindrical surface to provide stress relief for temperature related expansion and contraction of the mating components. According to a modified embodiment, the cylindrical surface extends only slightly more than 180° to thereby provide for snapping on/off engagement to greatly facilitate servicing of the system. According to another modification of the first embodiment, the portions of the base member and cover defining the outer ends of the channels are tapered to form a relatively sharp edge so that any contaminant particles which become seated on exposed portions of the slider, in effect, will be peeled or wedged off the slider as it is moved into the housing upon shifting of the gears. According to yet another modification of the first embodiment, the upper and lower blades of the slider are deformed so that preferably one side of each blade projects laterally to serve as a spring biased against the side wall of the channel so that the actuator is continuously referenced from a given location.

In a second embodiment, the actuator has a generally U-shaped cylindrical actuator member with a first leg extending from an end of the housing through an O-ring seal for a first length at least as long as the distance between the first and second extremities of the movable contact support and a second leg having a second, preferably longer length extending back toward the housing with a laterally extending manual valve coupling arm portion at the distal end of the second leg. A foraminous filter portion is formed in the base member to allow fluid flow therethrough and pressure equalization.

A third embodiment comprises an endless track formed in the housing with an elongated flexible band forming a loop having first and second opposite ends attached to the movable contact support on opposite sides of the manual valve coupling arm so that the band will be movable in the track as the movable contact support slides between the first and second extremities at the same time as blocking the slot in which the arm moves to prevent ingress of contaminant particles.

DETAILED DESCRIPTION OF PREFERRED EMBODIMENT

Figure 1:
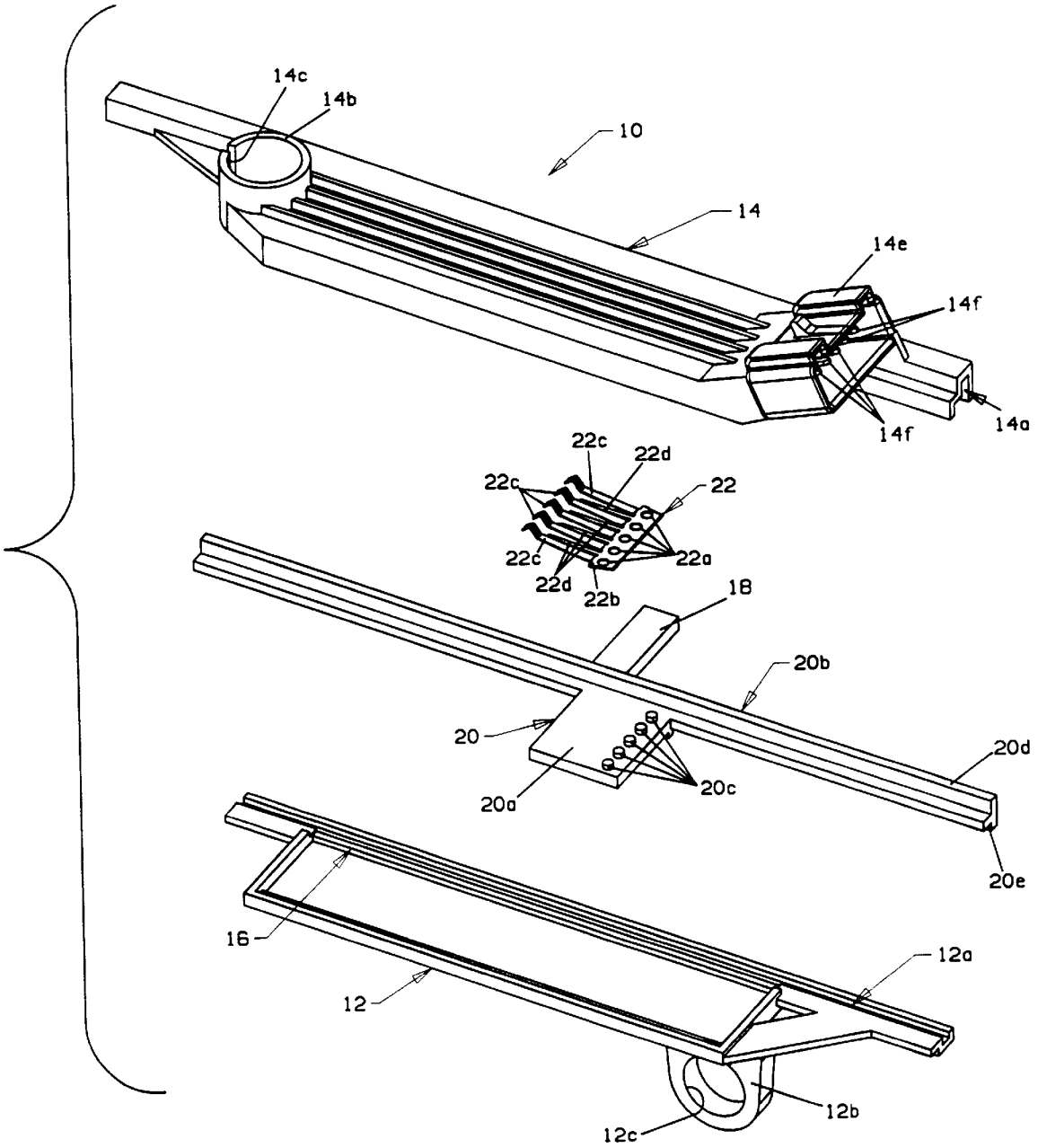
FIG. 1 is an exploded perspective of a switch system made in accordance with a first embodiment of the invention.
Figure 2:
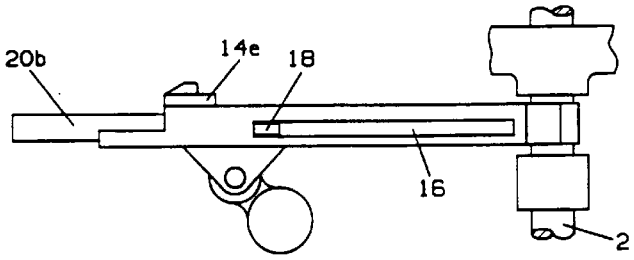
FIG. 2 is a front elevational view of the assembled FIG. 1 switch system turned 180° and slightly modified having a connector portion which is not angled as in FIG. 1 and with the system attached to a manual shaft and case boss of a motor vehicle transmission housing.

With reference to FIGS. 1–5, an internal transmission range switch system 10 made in accordance with a first embodiment of the invention comprises a housing made up of a base member 12 and cover 14. Base member 12 and cover 14 are preferably formed of any suitable electrically insulative moldable plastic material fitting together to form a recess or switch chamber therebetween and an elongated slot along one side of the housing for receipt therethrough of a manual shaft coupling arm 18. Arm 18 is integrally attached to actuator 20 which comprises a movable contact support 20*a* and slide element 20*b*. Movable contact support 20*a* is in the form of a plate with a plurality of cylindrical pegs 20*c* spaced along an edge thereof which are adapted to be received in respective apertures 22*a* of a base strip 22*b* of an electrically conductive movable contact assembly 22. Assembly 22 made be formed of any suitable electrically conductive material having good spring characteristics and comprises a plurality of cantilever contact arms 22*c* preferably augmented with reaction beams 22*d* so that a selected contact force will be required to deflect arms downwardly toward support 22*a* from an at rest raised position.

Base member 12 is formed with an elongated, upwardly opening channel 12*a* and cover 14 is formed with a corresponding, aligned, elongated downwardly opening channel 14*a* thereby forming a longitudinally extending opening in which is received lower and upper blade portions 20*d*, 20*e* respectively of slider element 20*b* which serve to block egress of contaminant particles carried in the transmission fluid into the recess of the housing through slot 16. Channel members 12*a*, 14*a* in combination with blade portions 20*d*, 20*e* form a tortuous path for such particles to enter the recess to enhance the effectiveness of the filtering action. Blade portion 20*f* (FIG. 4) extends parallel to and spaced from blade portion 20*e* with rib 12*d* received therebetween for stabilizing the orientation of the actuator relative to the housing.

Figure 3:
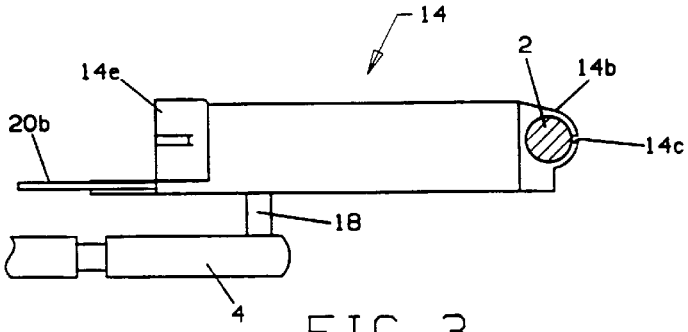
FIG. 3 is a top view of the FIG. 2 structure.
Figure 3A:
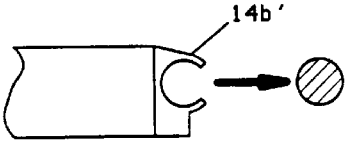
FIG. 3*a* is a broken away view of a modified portion of the manual shaft coupling socket.

Base member 12 has a flange 12*b* formed extending downwardly and provided with a bore 12*c* which bore serves as a mounting location for attachment to a boss of the transmission case or housing. A self-tapping bolt, not shown, can be used to attach the base member to the transmission housing. A second attachment point is provided by manual shaft receiving socket 14*b* formed in cover 14. Preferably, socket 14*b* forms a discontinuous cylindrical surface, provided by slot 14*c*, thereby providing stress relief for temperature related contraction and expansion of the cover and shaft. If desired, the discontinuous cylindrical surface can be formed into a snap on and snap off socket 14*b*' by having the continuous cylindrical surface extend slightly more than 180°, as shown in FIG. 3, e.g., approximately 200–250°. This feature is particularly advantageous with regard to servicing. That is, the cover can be removed without having to take the manual valve member out of the transmission.

Cover 14 is provided with stationary contacts 14*d*, as by insert molding in cover 14, extending longitudinally, i.e., in the direction extending from one end of the housing in the vicinity of socket 14*b* to the opposite end in the vicinity of an integrally formed connector shroud 14*e*. As seen in FIG. 1, contact terminals 14*f*, connected to respective stationary contacts 14*d*, extend into shroud 14*e* for connection to the transmission powertrain control module (not shown).

Figure 4:
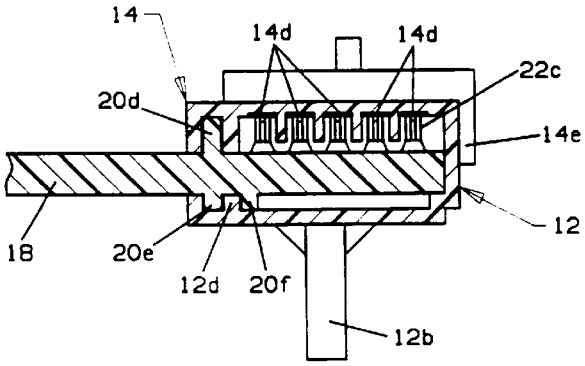
FIG. 4 is a cross section taken through the switch system at the movable contact support.
Figure 4A:
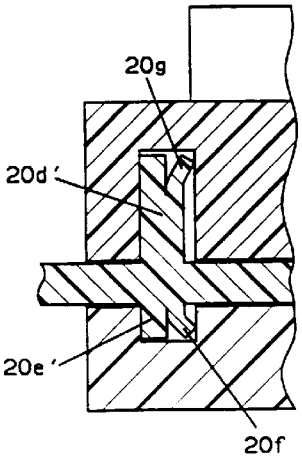
FIG. 4*a* is a broken away, enlarged portion of FIG. 4, showing a modified form of the actuator slider element.

According to an optional feature of the invention, blade portions 20*e*', 20*d*' can be deformed along the longitudinal direction either continuously or at spaced apart locations along the length of the slider elements so that a deformed portion 20*f* of lower blade portion 20*e*' and deformed portion 20*g* of upper blade portion extends laterally to be biased into engagement with a side wall of the respective channel as seen in FIG. 4*a*. This serves to maintain the undeformed portion of the blade elements biased against a referenced surface of the sidewalls forming the channel to improve the accuracy of the front to back location of the actuator in the housing, or side to side as seen in FIG. 4, as well as to more effectively block contaminants and prevent their passage across the channel. The upper and lower blade portions can be deformed on the same front or back surfaces of the blade elements as shown in FIG. 4*a* or, if desired, on the opposite front or back surfaces (not shown). It is within the purview of the invention to use other suitable means to serve as a reference and to impede contaminant ingress as by using an elastomeric seal in the channels.

Figure 5:
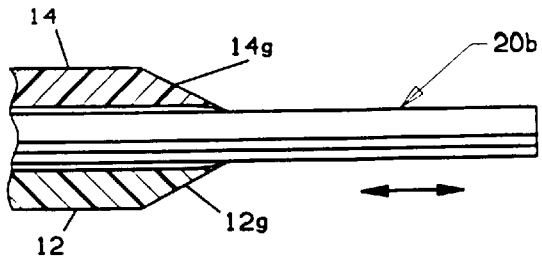
FIG. 5 is a broken away portion of a modified portion of the base member and cover defining an end of the slider element receiving channels.

According to another optional modification, as shown in FIG. 5, the base member 12 and housing 14 can be provided with tapered portions 14*g*, 12*g*, respectively, at each end of the channels forming a relatively sharp edge contiguous with the slider element so that any contaminant particles seated on the exposed portions of the slider element will be peeled or wedged off the slider element as it moves into the channels upon shifting of the gears.

Figure 6:
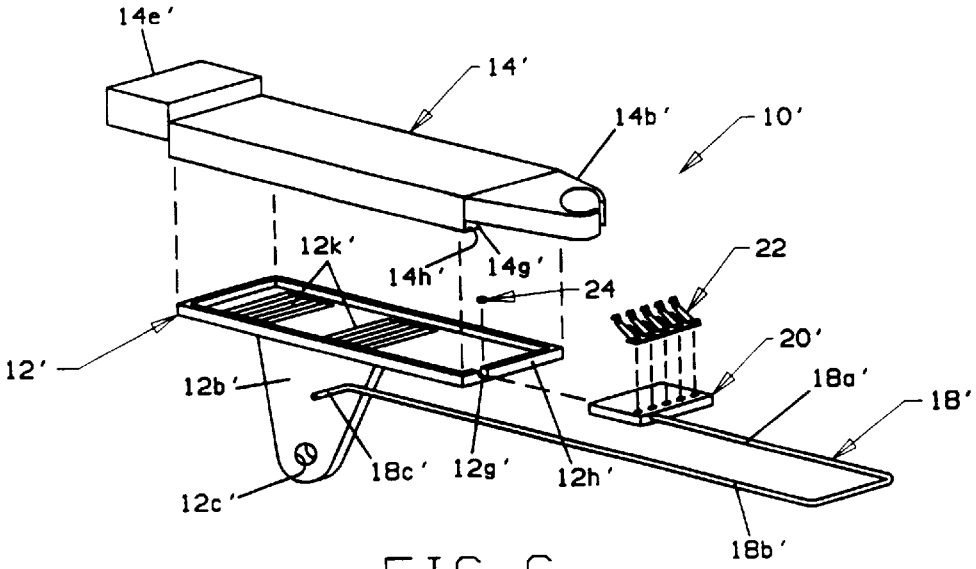
FIG. 6 is an exploded perspective of a second embodiment of the invention.
Figure 7:
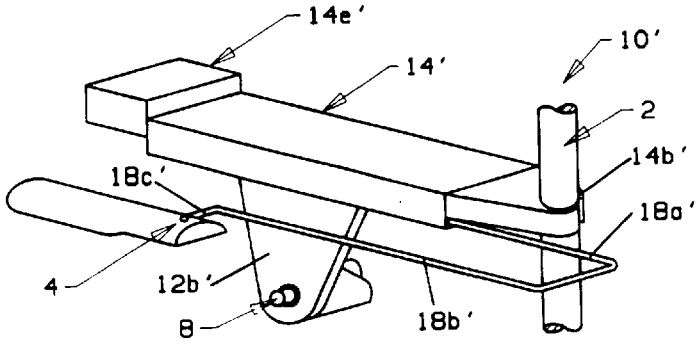
FIG. 7 is a perspective of the assembled FIG. 6 structure as mounted in a motor vehicle transmission.

A second embodiment of the invention is shown in FIGS. 6 and 7. Housing cover 14' is formed with a manual shaft receiving socket 14*b*' at one end and an electrical connector 14*e*' at an opposite end in the same manner as in the FIG. 1–5 embodiment. A suitable stationary contact assembly (not shown) is mounted in cover 14' as by insert molding, in the same manner as in the FIG. 1–5 embodiment with movable contact assembly 22 mounted on movable contact support 20' for sliding movement on base member 12' between first and second extremities in a recess formed between base member 12' and cover 14'. An elongated, generally cylindrical, U-shaped actuator member 18' has a first leg 18*a*' attached to movable contact support 20' and received through an O-ring 24 mounted in a circular bore 12*g*', 14*g*' in end wall 12*h*' of base member 12' and 14*h*' of cover 14'. Leg 18*a*' extends a length at least as long as the distance between the first and second extremities between which movable contact support 20' moves and is connected through a bight portion to second leg 18*b*' having a length preferably longer than that of leg 18*a*' and is provided at its distal end with an outwardly or transversely extending manual valve coupling arm 18*c*'. A filter in the form of insert molded foraminous sections 12*k*' is formed in the bottom wall of base member 12' to permit fluid flow into and out of the recess formed between base member 12' and cover 14' to equalize pressure differentials between the recess and the exterior of the switch housing particularly during movement of the actuator, while at the same time precluding ingress of contaminant particles larger than a selected size and thereby avoid interference with the switching function of the movable contacts.

As shown in FIG. 7, switch system 10' is attached to the manual shaft 2 through socket 14*b*', speed sensor wire clip bolt 8, or if desired, a boss on the transmission housing as in the FIG. 1–5 embodiment, and the manual valve 4. As in the FIG. 1–5 embodiment, as the manual valve member 4 moves along a straight linear path, this motion is transferred directly to the actuator through arm 18*c*' with the movable contacts of movable contact assembly 22 moving into and out of electrical engagement with the insert molded circuit thereby providing a selected, e.g., 4-bit output to the connector. The particular form of connection between arm 18*c*' and the manual valve can be provided for example by attaching directly to an extension of the manual valve, as shown in FIG. 7, to an extension of the manual valve clip, or to an overmolded component, as desired.

Figure 8:
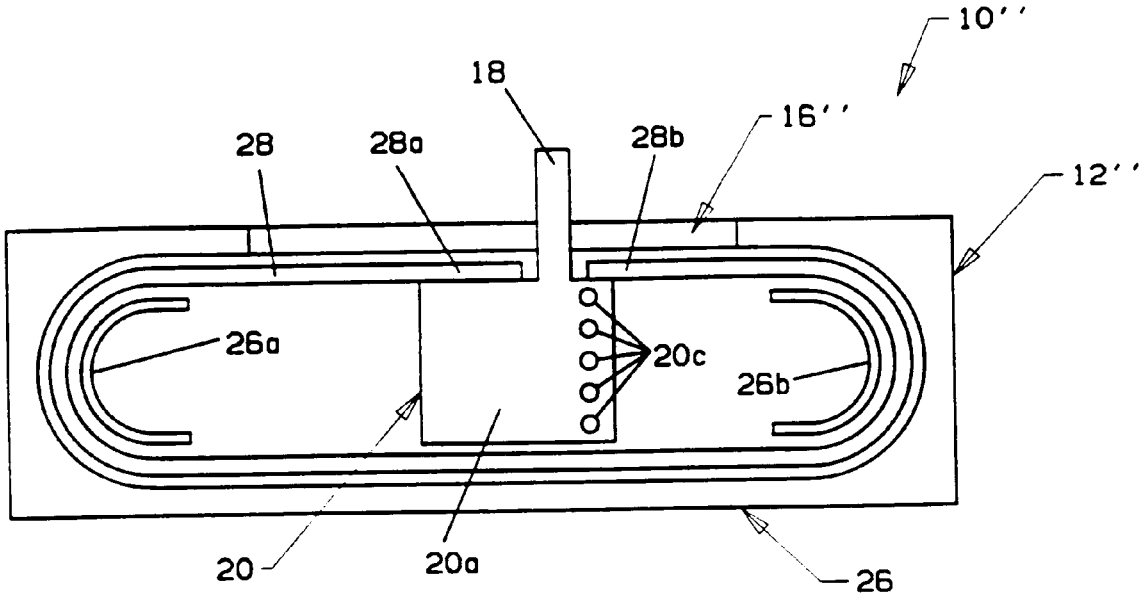
FIG. 8 is a top plan view of a third embodiment of the invention, with the cover removed for purposes of illustration.

A third embodiment is depicted in FIG. 8 which is a top plan view of switch system 10" with the cover removed for purposes of illustration. An endless track 26 is formed in base member 12", extending into the cover (not shown), if desired. Track 26 may be a groove and can include guide members 26*a,* 26*b* about which is received an elongated band 28 of flexible material, such as a polymer, having opposed ends 28*a,* 28*b* attached to movable contact support 20 on opposite sides of arm 18 forming a closed loop and adapted to block slot 16" and slide in track 26 as movable contact support 20 moves back and forth between the first and second extremities in dependence upon movement of the manual valve. The height of band 28 is selected to be greater than the height of slot 16" and is positioned contiguous to the sidewall of the base member and cover in which the slot is formed so that ingress of contaminant particles will be precluded. If desired, a foraminous filter section can be provided in the bottom wall of base member 12" as shown in the FIGS. 6, 7 embodiment. This embodiment provides the advantage of precluding contaminant particles ingress into the switch chamber in an optimally sized package.

It should be understood that although several preferred embodiments of the invention have been described in order to illustrate the invention, the invention includes various modifications and equivalents to the disclosed embodiments. It is intended that the invention include all such modifications and equivalents falling within the scope of the appended claims.

What is claimed:

1. An electrical switch system for use with motor vehicle transmissions having a manual valve comprising:

a housing comprising a base member and a cover forming a recess therebetween, a movable contact assembly having a movable contact support movable along a straight line on the base member between first and second extremities, at least one movable contact mounted on the movable contact support, at least one stationary contact mounted in the cover, the movable contact being slidable into and out of electrical contact engagement with the stationary contact upon movement of the movable contact support between the first and second extremities;

an arm connected to the movable contact support for coupling to a manual valve of a transmission, the arm extending through an opening formed through the housing to transmit motion from the manual valve to the movable contact support, said arm being generally U-shaped having first and second legs, the first leg bering attached to the movable contact support and being receivable in the recess through said opening in the housing the second leg being disposed externally of the recess, the second leg having a distal end portion for connection with the manual valve of a transmission, and means to prevent ingress of contaminant particles through said opening into the recess.

2. An electrical switch system according to claim 1 which the opening is generally circular and in which the means to prevent ingress of contaminate particles comprises an O-ring, the first leg of the arm being received through the O-ring.

3. An electrical switch system according to claim 1 in which the base member has a foraminous portion for excluding contaminant particles larger than a selected size while permitting fluid flow into and out of the recess.

4. An electrical switch system according to claim 1 further comprising a manual shaft receiving socket formed in the housing, the socket having a discontinuous cylindrical bore for stress relief at low temperatures.

5. An electrical switch system according to claim 1 further comprising a manual shaft receiving socket formed in the housing, the socket having a surface forming only slightly more than 180° of a cylindrical bore so that the socket can be snapped on and off a cylindrical manual shaft.

6. An electrical switch system for use with motor vehicle transmissions having a manual valve comprising:

a housing comprising a base member and a cover forming a recess therebetween, a movable contact assembly having a movable contact support movable along a straight line on the base member between first and second extremities, at least one movable contact mounted on the movable contact support, at least one stationary contact mounted in the cover, the movable contact being slidable into and out of electrical contact engagement with the stationary contact upon movement of the movable contact support between the first and second extremities; and an arm connected to the movable contact support for coupling to a manual valve of a transmission, the arm extending through an opening formed through the housing to transmit motion from the manual valve to the movable contact support, said opening formed through the housing being in the form of a slot extending adjacent to and along the recess and a flexible elongated band is connected to spaced portions of the movable contact support on either side of the arm forming a loop and extending in an endless track which has a portion extending proximate to and along the slot, the band being movable with the movable contact support for blocking access of contaminant particles through the slot.

7. An electrical switch system for use with motor vehicle transmissions having a manual valve comprising:

a housing comprising a base member and a cover forming a recess therebetween, a movable contact assembly having a movable contact support movable along a straight line on the base member between first and second extremities, at least one movable contact mounted on the movable contact support, at least one stationary contact mounted in the cover, the movable contact being slidable into and out of electrical contact engagement with the stationary contact upon movement of the movable contact support between the first and second extremities; and an arm connected to the movable contact support for coupling to a manual valve of a transmission, the arm extending through an opening formed through the housing to transmit motion from the manual valve to the movable contact support, said opening being formed through at least one of the base member and cover and being in the form of a slot having a selected length, a first channel being formed in the base member adjacent to and coextensive with the slot, a second channel being formed in the cover adjacent to and coextensive with the slot and the movable contact support being an elongated slider element having an upper blade portion received in the first channel and a lower blade portion received in the second channel, the slider element having a length sufficiently long that it covers the slot along the entire selected length of the slot when the movable contact support is in either of the first and second extremities to thereby serve to block ingress of contaminant particles into the recess.

8. An electrical switch system according to claim 7 in which the first and second channels having opposing sidewalls and the upper blade portion and the lower blade portion each have opposed first and second sidewalls and one of the first and second sidewalls of each portion is deformed so that it projects laterally from the element along at least spaced portions of the entire length so that the other of the first and second sidewalls of the upper and lower blade portions are biased into engagement with one of the opposed walls of the respective channels.

9. An electrical switch system according to claim 8 in which the deformed side of the upper and lower portions are on the same side of the slider element.

10. An electrical switch system according to claim 9 in which the base member and the cover defining the respective first and second channels each have open opposite ends allowing a portion of the slider element to be exposed externally of the housing by sliding beyond either end thereof.

11. An electrical switch system according to claim 10 in which the base member and cover defining the ends of the respective first and second channels are formed with a tapered surface leading away from a relatively sharp edge at each end contiguous to the slider element to skim away contaminant particles disposed on exposed portions of the slider element.

12. An electrical switch system for use with vehicular transmissions comprising:

a housing having a base member and a cover defining a recess therebetween and an elongated first opening having opposed ends defined through the housing along a side thereof, a movable contact assembly having a movable contact support disposed in the recess slidably along a straight path between first and second extremities, an arm extending from the movable contact support through an opening for connection to a manual valve of the transmission, an upwardly opening, open ended, first channel formed in the base member adjacent to and coextensive with first opening, a downwardly opening, open ended, second channel formed in the cover aligned and coextensive with the first channel, a slider element attached to the movable contact support and having an upper blade portion received in the first channel and a lower blade portion received in the second channel thereby closing the opening from top to bottom, the slider element sufficiently long so that it covers the opening from end to end when the movable contact support is in either of the first and second extremities.

13. An electrical switch system according to claim 12 in which the first and second channels have opposed sidewalls and a portion of the upper and lower blade portions are laterally deformed to be biased against the sidewalls of the respective channels.

14. An electrical switch system according to claim 13 in which the blade portions have opposed sidewalls and only one sidewall is deformed on each of the upper and lower blade portions.

15. An electrical switch according to claim 14 in which the deformed sidewall of the upper blade portion and the lower blade portion are on the same side of the respective blade portions.

16. An electrical switch system for use with vehicular transmissions comprising:

a housing comprising a base member and a cover with a recess formed therebetween, the housing having first and second ends and a manual valve receiving socket comprising a bore extending through the housing at an end of the housing, a movable contact assembly having a movable contact support movable along a straight line in the recess between first and second extremities, at least one movable contact mounted on the movable contact support, at least one stationary contact mounted in the cover exposed to the recess, the movable contact slidable into and out of contact engagement with the stationary contact upon movement of the movable contact support between the first and second extremities, an O-ring disposed in an aperture formed at an end of the housing, a generally U-shaped member having first and second legs, the first leg being attached to the movable contact support and having a first length greater than the distance between the first and second extremities and extending through the O-ring, the second leg having a second length longer than the first length and having a distal end portion for connection with a manual valve of a transmission.

17. An electrical switch system according to claim 16 in which the base member has a bottom wall and further comprising a foraminous filter formed in the bottom wall of the base member.

18. An electrical switch for use with vehicular transmissions having a manual valve comprising:

a housing comprising a base member and a cover received on the base member forming a recess therebetween, a movable contact assembly having a contact support movable along a straight line between first and second extremities disposed in the recess, at least one movable contact mounted on the movable contact support, at least one stationary contact mounted in the cover exposed to the recess, the movable contact being slideable into and out of electrical engagement with the stationary contact upon movement of the movable contact support between the first and second extremities, an arm connected to the movable contact support for coupling to a manual valve of a transmission, the arm extending through an elongated opening formed through the housing extending along the housing so that the arm can move with the movable contact support between the first and second extremities to transmit motion from the manual valve to the movable contact support, an endless track formed in the housing having a portion immediately adjacent to and coextensive with the elongated opening, a flexible elongated band attached to the movable contact support on opposite sides of the arm forming a loop received in the track, the band being movable with the movable contact support for blocking access of contaminant particles through the opening.

* * * * *